United States Patent [19]

Saito et al.

[11] 4,337,946

[45] Jul. 6, 1982

[54] GOLF BALL

[75] Inventors: Tasuku Saito, Tokorozawa; Tutomu Noma, Higashimurayama; Tsutomu Matsunaga, Iruma; Nagayoshi Naito, Nagoya; Chiaki Tanaka, Chita; Motoki Hiratsuka, Nagoya, all of Japan

[73] Assignees: Toray Industries, Inc.; Bridgestone Tire Company Limited, both of Tokyo, Japan

[21] Appl. No.: 204,554

[22] Filed: Nov. 6, 1980

[30] Foreign Application Priority Data

Nov. 8, 1979 [JP] Japan ..... 54-144857

[51] Int. Cl.[3] ..... A63B 37/06; A63B 37/12

[52] U.S. Cl. ..... 273/225; 273/235 R

[58] Field of Search ..... 273/235 R, 235 A, 235 B, 273/DIG. 9, 225, 233, 234

[56] References Cited

U.S. PATENT DOCUMENTS

| | | | |
|---|---|---|---|
| 3,454,280 | 7/1969 | Harrison et al. | 273/235 |
| 3,784,520 | 1/1974 | Hoeschele | 260/75 |
| 3,819,768 | 6/1974 | Molitor | 260/897 |
| 3,940,146 | 2/1976 | Little | 273/235 |
| 4,185,831 | 1/1980 | Tominaga | 273/235 |
| 4,272,079 | 6/1981 | Nakade | 273/235 R X |

*Primary Examiner*—George J. Marlo

*Attorney, Agent, or Firm*—Austin R. Miller

[57] ABSTRACT

A golf ball having an intermediate layer of thermoplastic resin between a thread-wound central core and an outer polyester elastomer layer. The thermoplastic resin has a substantial melt flow initiation temperature of 160° C. or less, the substantial melt flow initiation temperature being the minimum temperature at which the melt index under a load of 4350 g. becomes 1 g/10 mins or more, and has a high adhesion property to the polyester elastomer cover. It is preferable that the thermoplastic resin have a resilience of 30% or more and that the intermediate layer of thermoplastic resin be within the range of 0.1 to 1.0 mm. This golf ball has excellent cutting resistance, "click" characteristics and impact resilience.

7 Claims, 1 Drawing Figure

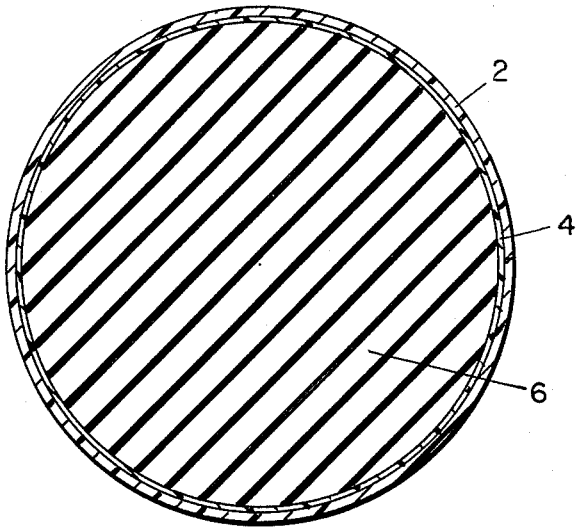
2
4
6

GOLF BALL

The present invention relates to a golf ball having a thread-wound central core and, more specifically, it relates to an improved golf ball having a thread-wound central core and an outer polyester elastomer cover.

Properties which are required for the cover of a golf ball are impact resilience sufficient to give a satisfactory flight distance, cutting resistance against the hitting by a club head, qualitative feeling such as "click" characteristics when the ball is hit by a club, a good affinity for the thread-wound core during the molding process and the like.

Used heretofore, as the cover materials of golf balls, are mainly trans-1,4-polyisoprene, such as gutta-percha and balata. However, since these materials are expensive, various attempts have been made to develop new materials which can substitute for those materials as the cover materials of golf balls. Among these new materials, metallic salts of copolymers of ethylene and $\alpha,\beta$-unsaturated carboxylic acids, that is, so-called ionomers, are used as the replacement for balata, on a commercial scale. However, although the ionomers exhibit an especially excellent cutting resistance, the "click" characteristics and impact resilience thereof are inferior to those of the golf balls having the balata cover. For these reasons, the ionomer golf balls have not still been accepted by skilled golfers.

It has been found, prior to the present invention, that golf balls having an outer cover mainly formed of special block copolyetherester exhibit excellent impact resilience and other satisfactory properties as disclosed in U.S. Ser. No. 119,640 filed on Feb. 8, 1980. However, since the block copolyetherester composition ranges which impart desired impact resilience, cutting resistance and "click" characteristics to the golf balls are relatively narrow, the freedom of selection of the materials is limited.

Accordingly, an object of the present invention is to overcome the afore-mentioned problems of the prior art and to provide an improved golf ball which exhibits superior cutting resistance, impact resilience and "click" characteristics.

Another object of the present invention is to provide an improved golf ball having outstanding properties, in which wide varieties of polyester elastomers can be used as the outer layer.

Other objects and advantages of the present invention will be apparent from the following description.

The FIGURE is a cross sectional view of a preferred embodiment of the golf ball of the present invention.

As shown in the FIGURE, there is provided a golf ball comprising (i) a thread-wound central core 6, (ii) an outer cover 2 for the core 6, said cover 2 being formed of, as a main ingredient, a polyester elastomer, and (iii) a layer of thermoplastic resin having a substantial melt flow initation temperature defined hereinbelow of 160° C. or less and having high adhesion to the polyester elastomer cover which is an intermediate layer 4 between the thread-wound central core6 and the outer polyester elastomer cover 2.

The term "a substantial melt flow initiation temperature" as used herein means the minimum temperature at which the melt index under a load of 4350 g becomes 1 g/10 mins or more.

According to the present invention, since the above-mentioned intermediate thermoplastic layer 4 is placed between the thread-wound center core 6 and the outer cover 2 of golf balls, the moldability or molding properties are improved compared to conventional golf balls, any outer cover materials having excellent cutting resistance, "click" characteristics and impact resilience can be advantageously used in the production of the golf balls.

The polyester elastomers used, as an outer cover material, in the present invention include, for example, polyetherester block copolymers, polylactone ester block copolymers, and aliphatic and aromatic dicarboxylic acid copolyesters.

The polyetherester block copolymers used in the present invention are those which are composed of (i) polyester hard segments comprising dicarboxylic acid components and low molecular weight diol components and (ii) polyether soft segments comprising copolymers of alkylene glycols of 2 to 10 carbon atoms. 40 mol% or more of the dicarboxylic acid components are preferably aromatic dicarboxylic acids such as terephthalic acid due to their mechanical properties such as break strength, resilience and the like. As the low molecular weight diol components, aliphatic and alicyclic diols of 2 to 10 carbon atoms can be preferably used alone or in any mixture thereof.

The polylactone ester block copolymers used as an outer cover material in the present invention, are those in which the soft segments (i.e the polyether chains) of the abovementioned polyetherester block copolymers are replaced with polylactone chains.

The aliphatic and aromatic dicarboxylic acid copolyesters used in the present invention are copolymers of (i) acid components comprising aromatic dicarboxylic acids (e.g. terephthalic acid and isophthalic acid) and aliphatic dicarboxylic acids of 2 to 10 carbon atoms and (ii) diol components comprising at least one member selected from the group consisting of aliphatic and alicyclic diols of 2 to 10 carbon atoms. Furthermore, blends of aliphatic polyesters and aromatic polyesters can also be used, as outer cover materials, in the present invention.

The above-mentioned polyester elastomers used, as an outer cover material, in the present invention can be prepared in any known manner. In order to impart a good cutting resistance to golf balls, the outer cover materials should preferably have a stress, at 10% elongation, of 10 through 200 kg/cm$^2$, more preferably 30 through 120 kg/cm$^2$. In addition, the outer cover materials preferably should have a resilience of 30% or more, more preferably 45% or more, to impart excellent flight characteristics to golf balls. According to the present invention, since the intermediate layer is used to improve the moldability, polyester elastomers having a higher melting point, compared with those used in conventional golf balls, can be used. However, in order to prevent the damage of the thread-wound core center and to facilitate the formation of dimples, the polyester elastomers having a substantial melt flow initiation temperature defined hereinabove of 190° C. or less are preferably used as the outer cover material in the present invention. The outer cover materials of the present invention can optionally contain, for example polymers other than the polyester elastomers, such as fillers, pigments, stabilizers and so on, as long as the above-mentioned requirements are satisfied.

The intermediate layer which is placed between the thread-wound center core and the outer polyester elastomer cover of the present invention is composed of thermoplastic resins having a substantial melt flow initiation temperature defined above of 160° C. or less and having high adhesion to the polyester elastomer cover.

In conventional golf balls, when the composition of the polyester elastomer outer cover is modified to improve the cutting resistance, an increase in the melting point of the polyester elastomer occurs. As a result, a high temperature is sometimes required in the press molding step of the outer cover on the thread-wound central core and, therefore, the moldability becomes worse. Contrary to this, according to the present invention, since the above-mentioned intermediate thermoplastic polymer layer is placed between the thread-wound central core and the outer cover, the thread-wound central core is coated with an intermediate layer at a relatively low temperature without damaging the rubber thread of the central core. This intermediate thermoplastic resin layer penetrates favorably with the thread-wound central core and satisfactorily adheres to the outer cover. Where the two half cups are joined together the intermediate layer keeps them tightly adhered to each other.

As mentioned above, the intermediate layer serves mainly to improve the affinity between the thread-wound central core and the outer polyester elastomer cover of golf balls. However, since the intermediate layer also serves as a portion of the outer cover, thermoplastic materials having a resilience as high as possible (e.g. 30% or more) and a stress at 10% elongation of 10 through 200 kg/cm$^2$ are preferably selected as the intermediate material in the present invention. The use of the intermediate thermoplastic materials having a substantial melt flow initiation temperature of 140° C. or less is more preferable in order to prevent damage to the thread-wound central core.

It should be noted that, when the intermediate layer is too thick, the superior characteristics of the outer cover cannot be fully seen in the performance of the golf balls. Contrary to this, a certain thickness of the intermediate layer is required for the improvement in the moldability of the golf balls. Therefore, the thickness of the intermediate layer is generally within the range of 0.1 to 1.0 mm, preferably 0.2 to 0.5 mm.

Examples of thermoplastic resins having a high adhesion property to the outer polyester elastomer cover and having a substantial melt flow initiation temperature of 160° C. or less, which are suitable for use in the formation of the intermediate layer of the present invention are: polyester elastomers which are prepared from monomers similar to those used in the preparation of the outer polyester elastomers and which have a low substantial melt flow initiation temperature (i.e. 160° C. or less); polyester elastomer compositions having a low melting point which are prepared by incorporating plasticizers (e.g. p-toluenesulfonamide, dimethyl isophthalate, bis-hydroxyethyl or-butyl isophthalate, polycaprolactone or resorcin) into the outer polyester elastomers having a high melting point; polyester elastomer compositions having a low melting point, which are prepared by blending the polyester elastomers having a high melting point with other thermoplastic resins. These intermediate materials are preferable from the point of view of the adhesion to the outer polyester elastomer materials.

In addition to the above-mentioned materials, copolyamide resins, ionomers (e.g. metallic salts of ethylene/acrylic acid copolymers), ethylene/vinyl acetate copolymers including partially saponified products thereof, styrene-butadiene-styrene tereblock copolymers, plasticized poly(vinyl chloride) containing 20 to 60% of plasticizers, unvulcanized rubber such as NBR, SBR, EPDM and the like, balata, gutta-percha and synthetic trans-1,4-polyisoprene, trans-1,4-polybutadiene, and syndiotactic-1,2-polybutadiene and the like can also be used as the intermediate layer in the present invention. These intermediate layers can optionally contain, for example, polymers other than the above-mentioned intermediate thermoplastic resins, plasticizers, pigments, stabilizers, fillers and so on, as long as the above-mentioned requirements are satisfied.

The golf balls of the present invention can be manufactured in any manner. For instance, half-cups (or half-shells) of the outer cover are injection molded and, then, an intermediate layer is formed inside of the half-cups by an injection molding. A thread-wound central core, which is previously prepared in a conventional manner, is then covered with the half-cups obtained above, and compression molded to form the golf ball of the present invention. In addition to the above-mentioned method, the following methods can also be used in the manufacture of the present golf balls.

(1) Half-cups, of the outer cover and the intermediate layer are formed, respectively, by using a cold molding or an injection molding. Then, a thread-wound central core is covered with the half-cups, of the intermediate layer and the outer cover, in this order, and, thereafter compression molded to form the present golf ball.

(2) The intermediate layer is formed on the entire surface of a thread-wound central core by injection molding. Over the intermediate layer, the outer cover is formed by injection molding or half-cups of the outer cover are covered and compression molded.

(3) A laminated sheet of the outer cover material and the intermediate material is first prepared and, then, half-cups are cold molded from the laminated sheet. A thread-wound core is placed between two half-cups and the ball assembly is compression molded to form the present golf ball.

The present invention is further illustrated in detail by, but is by no means limited to, the following Examples in which all parts and percentages are expressed on a weight basis, unless otherwise specified.

The golf balls obtained in the Examples below were evaluated as follows (1) Initial Velocity An initial velocity was determined by using a golf ball hitting test machine manufactured by TRUE TEMPER CORP., when the ball was hit with a No. 1 wood club with a club head speed of 45 m/sec and a ball temperature of 20° C.

(2) Cutting Resistance

A cutting resistance was determined by observing, with the naked eye, the marks caused on the surface of the golf ball after the golf ball was hit with a No. 7 iron at a pressure of 7 kg/cm$^2$. A golf ball hitting test machine manufactured by TRUE TEMPER CORP. was used.

(3) Substantial Melt Flow Initiation Temperature

The substantial melt flow initiation temperature was determined by using a melt indexer manufactured by TAKARA KOGYO KABUSHIKI KAISHA. The flow amounts of each sample were determined under a load of 4350 g at various temperatures according to the method similar to that defined in ASTM D-1238. The minimum temperature at which the melt index becomes 1 g/10 mins or more is defined as the substantial melt flow initiation temperature. The melt index is a flow rate (g/10 min.) measured at a temperature of 120° C. and at 5° increments thereabove (i.e., 125° C., 130° C., 135° C., etc.) determined by using the apparatus set forth in ASTM D-1238 under a load of 4350 g.

EXAMPLE 1

To 100 parts of a block copolyetherester prepared from a mixture of (A) terephthalic acid, (B) 1,4-butanediol and (D) poly(tetramethylene glycol) having a number-average molecular weight of 1000 (the content of the component (D) in the block copolyetherester was 65%) and having a specific gravity of 1.12 and a substantial melt flow initiation temperature of 189° C., 3 parts of titanium dioxide was added. The resulting composition was injection molded at a cylinder temperature of 200° C. to form outer covers in the form of half-cups having a wall thickness of 1.5 mm.

To 100 parts of a block copolyetherester prepared from a mixture of (A) terephthalic acid, (B) 1,4-butanediol, (C) isophthalic acid and (D) poly(tetramethylene glycol) having a number-average molecular weight of 1000 (a mol ratio of the component (C) to the component (A) was 40/60 and the content of the component (D) in the block copolyetherester was 50%) and having a specific gravity of 1.12 and a substantial melt flow initiation temperature of 130° C., 3 parts of titanium dioxide was added. The resultant composition was injection molded at a cylinder temperature of 140° C. to form intermediate layers in the form of half-cups having a wall thickness of 0.5 mm.

The golf ball was then prepared by covering a thread-wound core mainly containing cis-1,4-polybutadiene with the two half-cups of the intermediate layer and subsequently with the two half-cups of the outer cover and, then, molding the resultant assembly of the golf ball in a mold for the desired golf ball under a pressure of 1 ton per ball at a temperature of 165° C. for 1 minute. Thus, golf balls, each having a weight of 45.4 g were obtained.

The initial velocity of the balls thus obtained was 67.8 m/sec and the cutting resistance thereof was good and satisfactory.

EXAMPLE 2

Golf balls having a weight of 45.7 g were prepared in a manner as described in Example 1, except that, to 100 parts of a block copolyetherester prepared from above-mentioned components (A), (B), (C) and (D) (a mol ratio of the component (C) to the component (A) was 50/50 and the content of the component (D) in the block copolyetherester was 20%) and having a specific gravity of 1.23 and a substantial melt flow initiation temperature of 125° C.), 3 parts of titanium dioxide was added and the resultant composition was used as an intermediate layer.

The initial velocity of the balls thus obtained was 66.7 m/sec and the cutting resistance thereof was good and satisfactory.

COMPARATIVE EXAMPLE 1

Golf balls were prepared by directly covering the thread-wound core used in Example 1 with the outer cover material of Example 1 and, then, molding the resultant assembly of the golf ball in a mold for the desired golf ball under a pressure of 1 ton per ball at a temperature of 165° C. for 2 minutes. However, the golf balls were not desirably molded because the two half-cups of the outer cover were not completely united.

EXAMPLE 3

As the outer cover material, a composition prepared by adding 3 parts of titanium dioxide to 100 parts of a copolyetherester comprising the above-mentioned components (A), (B), (C) and (D) (the mol ratio of a component (C) to the component (A) was 20/80 and the content of the component (D) in the copolyetherester was 30%) and having a specific gravity of 1.21 and a substantial melt flow initiation temperature of 180° C. was used. This material was injection molded at a cylinder temperature of 200° C. to form outer covers in the form of half-cups having a wall thickness of 1.5 mm.

The golf balls were prepared by covering the thread-wound core with the intermediate layer of Example 1 and the outer cover obtained above and, then, molding the resultant assembly in the mold under a pressure of 1 ton per ball at a temperature of 165° C. for 1 minute. Thus, golf balls each having a weight of 45.5 g were obtained.

The initial velocity of the balls thus obtained was 66.2 m/sec and the cutting resistance thereof was excellent.

COMPARATIVE EXAMPLE 2

Golf balls were prepared by directly covering the thread-wound core with the outer cover material of Example 3 and, then, molding the resultant assembly in the mold under a pressure of 1 ton per ball at a temperature of 165° C. for 2 minutes. However, the golf balls were not desirably molded because the two half-cups of the outer covers were not completely united together.

EXAMPLE 4

A block copolyester having a specific gravity of 1.16 and a substantial melt flow initiation temperature of 165° C. was prepared by a mixture of the above-mentioned components (A), (B), (C) and (D) in which a mol ratio of the component (C) to the component (A) was 30/70 and the content of the component (D) in the block copolymer was 50%. 3 parts of titanium dioxide was added to 100 parts of the block copolyetherester obtained above to prepare a composition. From this composition, outer covers in the form of half-cups were prepared in a manner as described in Example 1.

A composition comprising 80 parts of an ionomer (Surlyn 1557®), 20 parts of the block copolyetherester used as the intermediate layer material in Example 1 and 3 parts of titanium dioxide was prepared. The substantial melt flow initiation temperature of this composition was 126° C. By using this composition, intermediate layers in the form of half-cups were prepared under the same conditions as described in Example 1.

The thread-wound central core was covered with the above-mentioned intermediate layer and outer cover in this order and, then, the resultant assembly was molded in the mold under a pressure of 1 ton per ball at a temperature of 145° C. for 2 minutes. Thus, golf balls each having a weight of 45.6 g were obtained.

The initial velocity of the balls thus obtained was 66.5 m/sec and the cutting resistance thereof was good.

COMPARATIVE EXAMPLE 3

Golf balls were prepared by directly covering the thread-wound core with the outer cover material of Example 4 and, then, molding the resultant assembly in the mold under a pressure of 1 ton per ball at a temperature of 145° C. for 2 minutes. However, the outer covers were not completely united together.

We claim:

1. A golf ball comprising a thread-wound central core, an outer cover for the core, said cover being formed of a polyester elastomer and a layer of thermoplastic resin disposed between said cover and said core, said layer having a substantial melt flow initiation temperature of 160° C. or less, said substantial melt flow initiation temperature being the minimum temperature at which the melt index under a load of 4350 g becomes 1 g/10 mins or more, and said layer having high adhesion to the polyester elastomer cover.

2. A golf ball as claimed in claim 1, wherein said polyester elastomer has a stress at 10% elongation of 10 through 200 kg/cm$^2$.

3. A golf ball as claimed in claim 1, wherein said polyester elastomer has a resilience of 30% or more.

4. A golf ball as claimed in claim 1, wherein said polyester elastomer has a substantial melt flow initiation temperature of 190° C. or less.

5. A golf ball as claimed in claim 1, wherein said thermoplastic resin has a stress at 10% elongation of 10 through 200 kg/cm$^2$.

6. A golf ball as claimed in claim 1, wherein said thermoplastic resin has a resilience of 30% or more.

7. A golf ball as claimed in claim 1, wherein the thickness of the intermediate thermoplastic resin layer is within the range of 0.1 to 1.0 mm.

* * * * *